US005553712A

United States Patent [19]

Tisbo et al.

[11] Patent Number: 5,553,712

[45] Date of Patent: Sep. 10, 1996

[54] TRADING CARD CARRYING AND DISPLAY CASE

[75] Inventors: Thomas A. Tisbo, Barrington Hills; Stephen P. Whitehead, Elgin; Michael G. Uffner, Naperville, all of Ill.

[73] Assignee: Suncast Corporation, Batavia, Ill.

[21] Appl. No.: 435,874

[22] Filed: May 5, 1995

[51] Int. Cl.[6] ..... B65D 51/18; B65D 43/16

[52] U.S. Cl. ..... 206/752; 206/449; 206/455; 220/259; 220/505; 220/522; 220/761

[58] Field of Search ..... 206/45.13, 45.15, 206/449, 455, 456, 752; 220/259, 505, 521, 522, 532, 533, 755, 756, 761

[56] References Cited

U.S. PATENT DOCUMENTS

| | | | |
|---|---|---|---|
| 1,933,894 | 11/1933 | Clink | 220/522 |
| 4,261,465 | 4/1981 | Thomas | 220/533 |
| 4,322,001 | 3/1982 | Hurley . | |
| 4,611,713 | 9/1986 | Byrns | 206/522 |
| 5,087,145 | 2/1992 | Cooley . | |
| 5,147,041 | 9/1992 | Lemieux et al. . | |
| 5,158,175 | 10/1992 | Crawford . | |
| 5,186,566 | 2/1993 | Cameron . | |
| 5,193,706 | 3/1993 | Hanna | 220/761 |
| 5,257,721 | 11/1993 | Smith et al. | 220/533 |
| 5,299,688 | 4/1994 | McKay . | |
| 5,358,100 | 10/1994 | Wolff | 206/45.13 |
| 5,462,167 | 10/1995 | Polinski et al. | 206/455 |

*Primary Examiner*—Jimmy G. Foster

*Attorney, Agent, or Firm*—McHale & Slavin, P.A.

[57] ABSTRACT

The instant invention is a container designed specifically for storing and displaying trading cards. The container has a main storage area, a hidden storage area, and a display floor. Construction allows for the stackability of containers by use of a lower tab which engages a peripheral edge formed by molded indicia placed on the upper surface. The main storage compartment of the container includes two fixed dividers allowing for placement of trading cards along the longitudinal length of the container wherein slots are provided for placement of loose leaf dividers allowing for individual separation. Between the two fixed dividers is another storage area having an increased depth which allows for placement of oversized cards or specialty cards. When the lid is placed in an open position, the handle operates as a stand and the bottom surface of the lid provides a card display area. When the lid is in the closed position and the handle placed in a storage position, lifting of the cover reveals a hidden compartment wherein the upper surface of the lid includes four individual compartments for placement of trading cards. The handle includes a locking notch to secure the handle is a raised position preventing access to the hidden compartment. An over-center hinge secures the cover to the bin locking the lid therebetween. One end of the hinge includes an aperture for insertion of a padlock hasp.

20 Claims, 6 Drawing Sheets

TRADING CARD CARRYING AND DISPLAY CASE

FIELD OF THE INVENTION

This invention relates to storage devices and more particularly to a carrying and display case for sports cards.

BACKGROUND INFORMATION

Trading cards are flat, usually rectangular pieces of pasteboard, cardboard, or plastic that are ornamented with pictures and statistics of famous sports figures. An individual may choose to obtain cards to determine the statistics of a sports player. Another may collect cards of athletes or sports teams as a hobby. Others may collect cards for the purposes of financial gain wherein their expertise lies in an ability to purchase an undervalued sports card for resale at a profit. The cards may acquire their economic value due to the rarity of a particular card in relation to the sport's figure whose picture and statistics are depicted on the card. Despite the nature of collecting, a true hobbyist or collector may have a sizeable amount of trading cards representing a large sentimental or monetary investment.

In many aspects the trading of cards resembles trading stock as the purchaser needs to speculate as to the worth of a particular card. If a purchase is performed in a timely manner the result may realize a profit. Unlike stock, the value of trading cards is dependent upon the condition in which the card is maintained. A card that is torn, frayed, or otherwise damaged may have minimal value whereas an identical card in good condition may be a valuable commodity.

One of the problems with collecting trading cards is the necessity of proper storage to optimize resale value. It is not unheard of for a valuable card collection to be stored in shoe boxes. The shoe boxes may be stacked on top of each other providing a certain amount of rigidity but should a person accidentally place a weight against the box the contents therein may be easily damaged. Further, the stacking of shoe boxes requires a uniformity which is difficult to obtain as an average household may have a diverse assortment of shoe box sizes, even if acquired by the same person. This problem is further complicated if trading cards are placed in plastic sleeves. The sleeves which are designed to protect forces the cards to stand out, exposing them to damage.

A number of baseball card protectors and carrying cases in the prior art all attempt to maintain the integrity of the trading card during storage. For instance, U.S. Pat. No. 5,344,015 discloses a card holder and carrying case for trading cards having individual thermo plastic crystal polystyrene holders in which a single trading card is placed. Each holder has a lower portion available for a snap fit engagement to a base allowing for the viewing of the trading cards without the possibility of bending or folding the cards. A disadvantage to this invention is the space consumption necessitated by having each card individually protected and the necessity of a holder base with spaced apart connecting receptacles. No provision is made with the device allowing for the stackability of multiple containers. In addition, the cost for a young hobbyist may be exorbitant.

U.S. Pat. No. 5,147,041 discloses a storage container for sports cards having a slidable insert which fits into a rigid external enclosure. While the housing has sufficient rigidity so as to allow stacking, there are no provisions made for stable stacking of such enclosures.

U.S. Pat. No. 5,158,175 sets forth a combination sorter box and display tray fabricated from cardboard. This device provides a low cost holding tray with sequential sorting compartments. The rigidity of the device is compromised by the cardboard structure which assimilates a shoe box.

U.S. Pat. No. 5,299,688 discloses a storage device having removable dividers arranged to allow for adjustable spacing between each divider. Unique to this invention is the tongue and groove coupling which allows like storage containers to be coupled in an adjacent manner, however, no provisions are made for stable stacking of the devices.

U.S. Pat. No. 5,087,145 discloses a trading card holder constructed from a transparent material which operates as a viewing container in the form of a binder. This device does not accommodate large quantities of cards and the stackability depends upon the amount of cards placed within each binder.

U.S. Pat. No. 4,322,001 discloses a protective case for sports cards which is directed to the storage of a single card within the container.

U.S. Pat. No. 5,186,566 discloses a baseball card storage and display device which allows for the multiple storage of cards within a binder type setting wherein the cards are placed within the transparent piece of plastic having a releasable locking mechanism to securely store the cards within the holder.

Thus, what is needed in the art is a card storage and display case capable of storing thousands of cards in a safe and secure manner as well as providing provisions for display and further having an ability to store various size cards such as those placed within protective holders as well as cards within a shipping box in a separate compartment concealed from viewing. It is further desired to provide a storage container having provisions for stacking in a stable and secure manner.

SUMMARY OF THE INVENTION

The instant invention is a plastic trading card storage and display container based upon a bin which forms a storage cavity with pre-formed chambers so as to accept trading cards along a front and rear chamber. Each fixed divider includes the ability to place up to twelve individual loose leaf dividers allowing the chambers to be organized according to league, team, player, year, and so forth. The dividers are further spaced apart forming a center chamber capable of housing non-uniform trading cards such as those placed within a plastic shield. The center chamber has a bottom wall which is placed at a level less than the front and rear chamber so as to prevent damage from a lid when the bin is in a closed position. A lid that is placed over the storage cavity has a bottom surface with a plurality of ribs for the temporary display of trading cards when the lid is in an open position. A handle rotatably coupled to an upper surface of the lid operates as a stand when the lid is in an open position providing a horizontal plane parallel to an upper peripheral edge of the bin.

The storage cavity is capable of holding approximately two thousand cards with front and rear chambers holding loose cards in two parallel rows and a center chamber which provides four distinct slots for protected cards or card boxes.

When the lid is in a closed position a hidden compartment is revealed which holds four boxes of thirty-five cards plus an additional fifty cards. The secret compartment has depressions placed within the surface and finger holes allowing access to the side of the stored cards so that the removal may take place without damaging the cards. A recessed aperture is provided allowing the handle to be placed flush to the lid surface. The lid is attached to the bin by a hinge, the lid providing a peripheral edge forming a complimentary mating edge to an upper peripheral edge of the bin.

A cover is attached to the lid by a second hinge. The cover includes a centrally disposed U-shaped aperture with a locking notch which engages a locking lug on each handle arm attached to the lid. In this manner, the handle may be placed in an upright vertical position allowing it to be used in its ordinary, conventional manner for transporting the container. The locking lug, when engaged with the locking notch prevents the cover from being lifted so as to conceal the upper surface of the lid as a secret compartment. When the cover is in a closed position, a latch is provided for holding the cover to the bin thereby securing the lid therebetween. The latch has a face plate which is pivotally connected to the front wall of the bin engaging a locking lip located on the top surface of the cover. The latch is pivotally connected to the front surface by use of a double-jointed pivot having a plurality of co-axial first pivot pins spaced in a fixed and substantially parallel relation from a second effective pivot pin providing an over center latching mechanism securely positioning the cover against the lid and the lid against the bin. A through hole is provided along a lower edge of the face plate of the latch which fits over a tab molded into the front surface of the bin for which a padlock may be placed.

To access the upper surface of the lid, the handle is rotated from its carrying position in a vertical stance to a horizontal position wherein the handle fits through the U-shaped aperture and rests in the U-shaped receptacle of the lid. Upon rotation of the handle, the locking lug is disengaged from the locking notch thereby allowing the cover to be rotated in an upward position while the lid is maintained in a horizontal position in relation to the bin. When the cover is rotated upwardly, the secret compartment is revealed where trading cards may be placed. When the cover is closed the storage container has an aesthetically pleasing display wherein a first area is provided for placement of personalized graphic indicia such as a list of storage contents, an emblem of the team that is represented within the storage container, the year the storage container was filled, and so forth. A second area has graphic indicia molded therein providing a textured surface that is appealing. The graphic indicia further forms a raised ridge around an outer perimeter of the indicia which allows for nesting of additional storage containers. A bottom surface of the storage container includes an outwardly extending tab which operates to maintain the bottom wall a predetermined distance from a floor surface to lessen condensation as well as allow for nesting onto a similar container having a complimentary surface. The outwardly extending tab fits along an outer edge of the graphic indicia allowing for the secure nesting.

Thus, an objective of the instant invention is to provide a storage container specifically designed to protect and organize trading cards.

Yet another objective of the instant invention is to provide a storage container capable of holding approximately two thousand cards with multiple levels of storage.

Yet another objective of the instant invention is to provide a storage container having a hidden compartment for placement of the most valuable trading cards which is locked in position very discretely and accessed by proper placement of the carrying handle.

Yet another objective of the instant invention is to provide a latch which secures the cover in a fixed position having a padlock ring which allows the user to lock the container securing the lid therebetween.

Still another objective of the instant invention is to provide a trading card display surface having a plurality of raised ribs for placement of trading cards wherein the display surface is maintained in a horizontal plane parallel to an upper peripheral edge of the storage container by use of the handle locked in position by a locking lug and notch providing a secure stand for the display surface.

Other objectives and advantages of this invention will become apparent from the following description taken in conjunction with the accompanying drawings wherein are set forth by way of illustration and example, certain embodiments of this invention. The drawings constitute a part of the specification and include exemplary embodiments of the present invention and illustrate various objects and features thereof.

DETAILED DESCRIPTION OF THE DRAWINGS

DETAILED DESCRIPTION

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
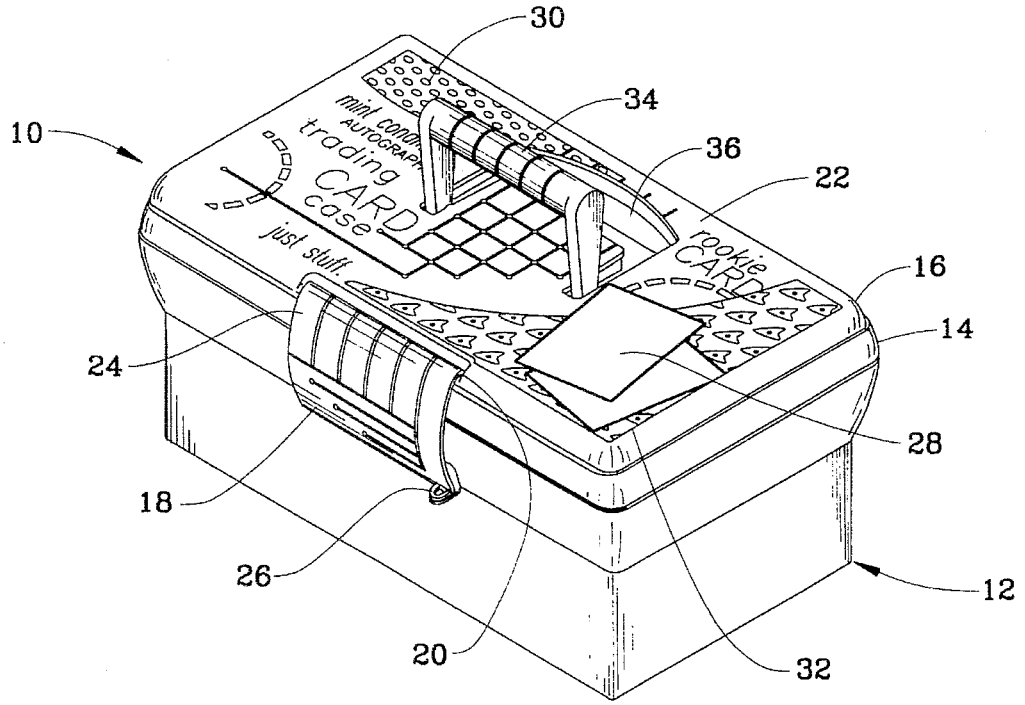
FIG. 1 is a perspective view of the trading card and display container of the instant invention.

Now referring to FIG. 1, shown is a perspective view of the plastic trading card storage and display container 10 having bin 12, lid 14, and cover 16. Latch 18 holds the cover to the bin 12 by use of a locking lip 20 located on an upper surface 22 of the cover which engages a locking end 24 of the latch 18. The latch may be secured by use of padlock hole 26 securing the cover 16 to the bin 12 with the lid 14 therebetween. The upper surface of the container 10 includes a first area 28 for placement of personalized indicia such as the collector's name, or reference to the type of collection placed within the container. A second area 30 includes molded indicia raised from the upper surface 22 providing an aesthetically pleasing design to the container 10 further providing a raised edge 32 around the peripheral of the second area 30 used for positioning a second container, not shown, on the cover 16. The second container having an outwardly extending tab as described in detail later in this specification which fits about the raised edge 32 thereby allowing for the secure nesting of multiple containers. Handle 34 is provided for transporting of the container 10 in a conventional manner. The cover 16 has an aperture 36 allowing for the folding of the handle 34 into a flush plane.

Figure 2:
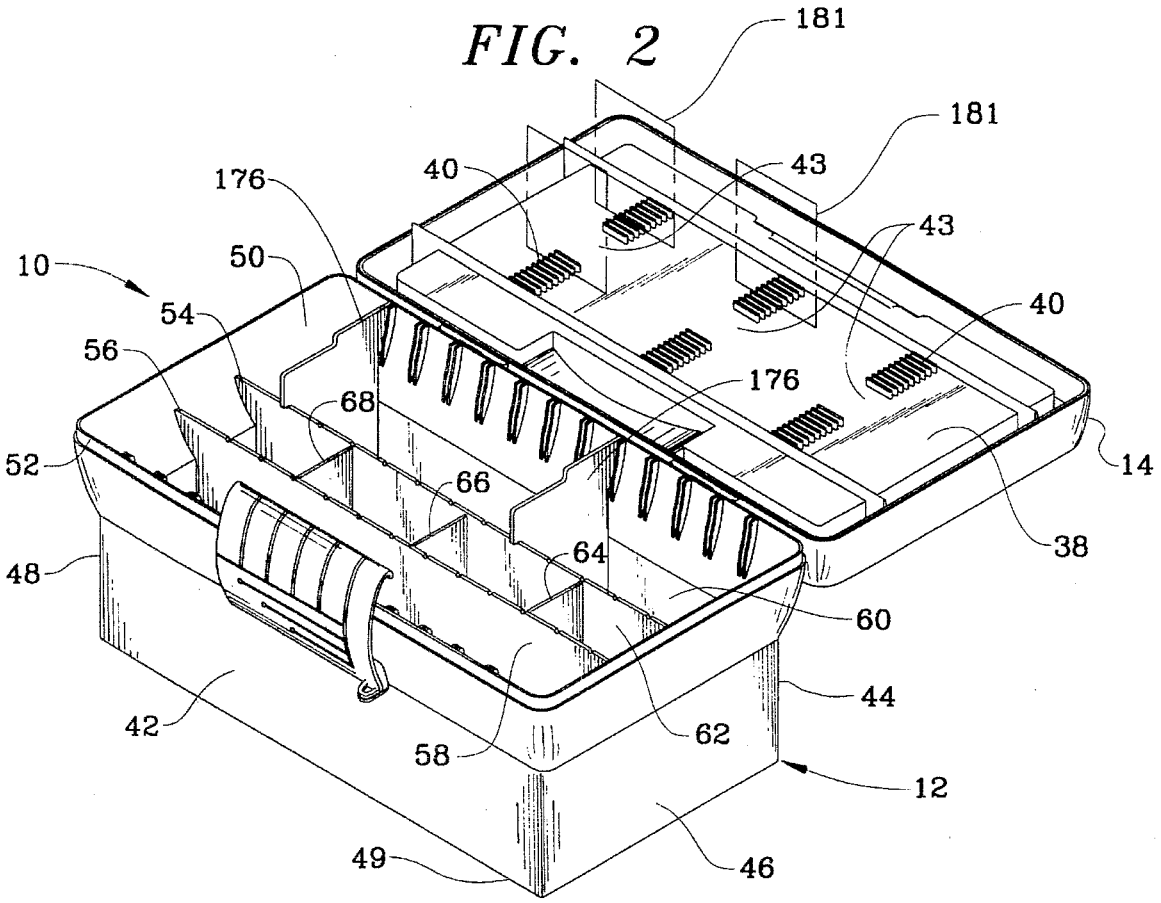
FIG. 2 is a perspective view of the container with the cover and lid in an open position.

FIG. 2 sets forth a perspective view of the trading card container 10 with lid 14 and cover 16 placed in an open position. Although not shown, the handle operates as a stand allowing the lid to be supported in a horizontal plane. The lower surface 38 of the lid 14 has a plurality of tabs 40 receptive to the placement of trading cards for display thereof. Examples of trading cards are depicted by numerals 181. The tabs 40 are spaced apart to allow each card adequate support against the surface 38 where the cards can be slightly tilted for ease of viewing. A center portion denoted by numeral 43 is void of display tabs as this area is left open for increased height for the center chamber during closure, to be explained in more detail later in this specification. The bin 12 is further defined by a front wall 42, a rear wall 44, a first side wall 46, a second side wall 48 and a bottom wall 49 forming a storage cavity 50 bounded by an upper first peripheral edge 52. The storage cavity 50 is separated by a first divider 54 and a second divider 56 forming a front wall chamber 58 and a rear wall chamber 60. Each chamber allows for the placement of a plurality of trading cards in an upright manner, perpendicular to a longitudinal length of the bin. Plastic looseleaf dividers 176 provide adjustment along the length of each chamber by placement in receptacles molded into inner surface of the front and rear walls and positioning over detentes set forth in the fixed dividers as described later. The fixed dividers 54, and 56 further form a central chamber 62 which is divided by cross connects 64, 66 and 68. Said cross connects provide for the center chamber 62 to have four separate sections for placement of specialty cards in an upright and parallel manner to said longitudinal length. The specialty cards may include over-sized cards or cards placed in individual protective containers. As described later in this specification the center chamber 62 has a bottom wall section which is at a distance lower than the bottom section of the front chamber 58 and the rear chamber 60. In addition, as previously described upper surface 38 has an area approximated by numeral 43 wherein there is a void of tabs 40 which allows for increased height when the lid 14 is placed in a closed position allowing the void 43 to be placed over the center chamber 62 which operates in conjunction with a lowered bottom wall so as to provide increased protection to the specialty cards placed within said center chamber.

Figure 3:
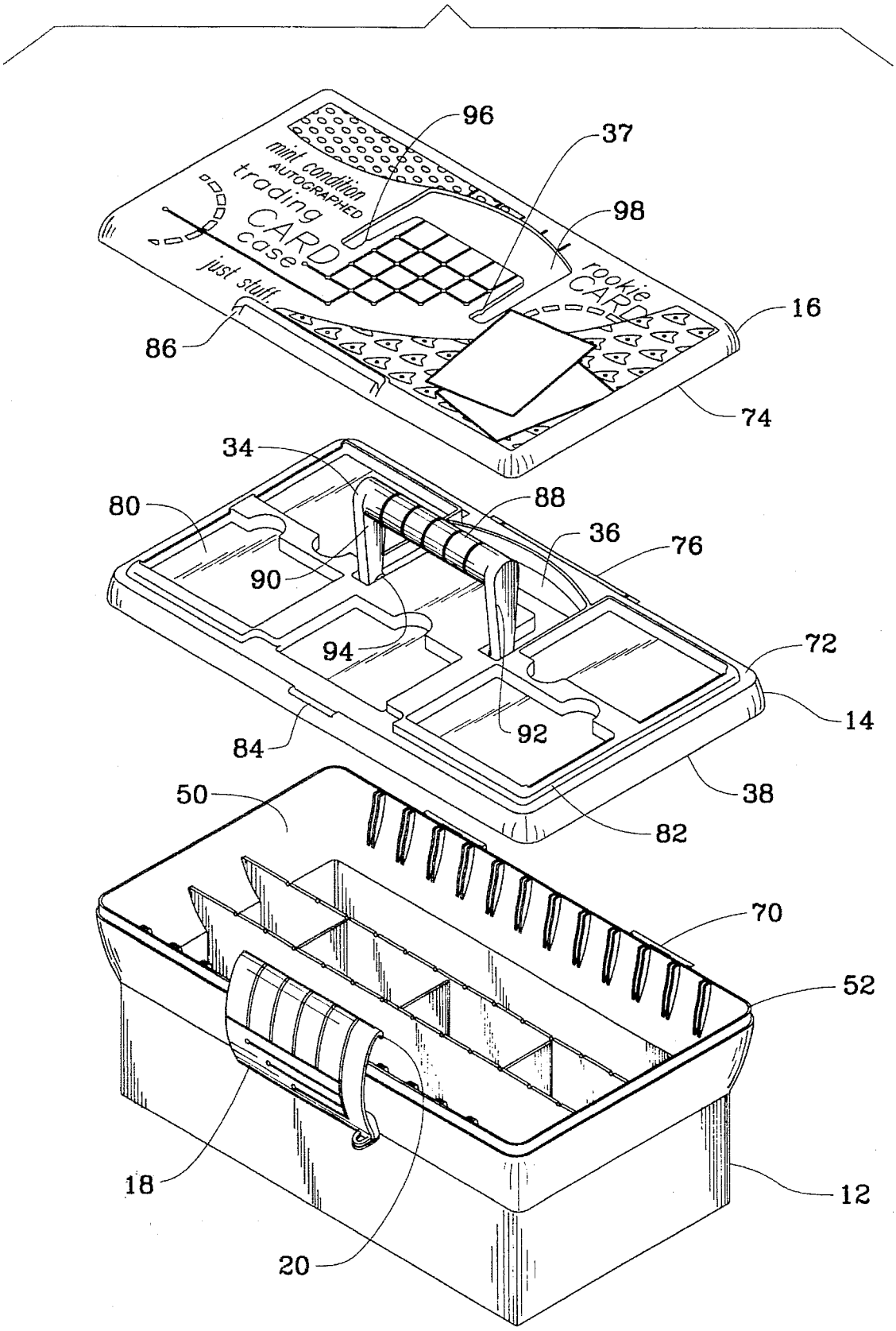
FIG. 3 is an exploded view.

Referring to FIG. 3 shown is an exploded view of the instant invention having the bin 12 with peripheral edge 52 and hinge 70 which form a complimentary surface to lower surface 38 of lid 14, the hinge is operatively associated with the hinge bracket on lid 14 allowing the lid to pivot about hinge 70 providing access to storage cavity 50. The lid has an upper surface 72 which forms a complimentary surface to bottom surface 74 to the cover 16. Hinge 76 is operatively associated with a hinge attachment on cover 16 allowing the cover to rotate so as to reveal the recessed compartments 80 described in detail later in this specification.

Handle 34 is shown in an upright position with U-shaped handle receptacle 36 formed in the upper surface of the lid allowing the handle to be placed in a flush position. Recessed card holders 80 allow for a raised ridge 82 formed about the peripheral of the card holders 80 and handle receptacle 36. The raised ridge 82 has a curved edge allowing for positioning of a receiving edge on the bottom surface 74 of the cover 16 thereby forming a combination that appears to be a single top when the cover 16 and lid 14 are coupled together. Notch 84 is provided on the edge of the lid 14 for ease in lifting the cover 16 when the handle 34 is placed in a lowered position. The cover 16 is shown with U-shaped aperture 37 and locking lip 86 which engages locking end 20 of latch 18 when the cover is to be secured to the bin 12. The handle 34 has a handle grip 88 with a first handle arm 90 and a second handle arm 92. Shown in this illustration, the handle arm has locking notch 94 which is an indentation placed on the inner surface of the handle arm 90 which is operatively associated with locking lug 96 which extends outwardly along an inner edge of the U-shaped aperture 37 found on the cover 16. In this manner when the handle 34 is placed in an upright vertical position within locking notch 96 biased against the locking lug 94 so as to maintain handle grip 88 in a raised position locking the cover to the lid. A locking notch, not shown, is also provided on handle arm 92 with a locking lug 98 positioned on the opposite side of the U-shaped aperture 37 formed in the cover 16.

Figure 4:
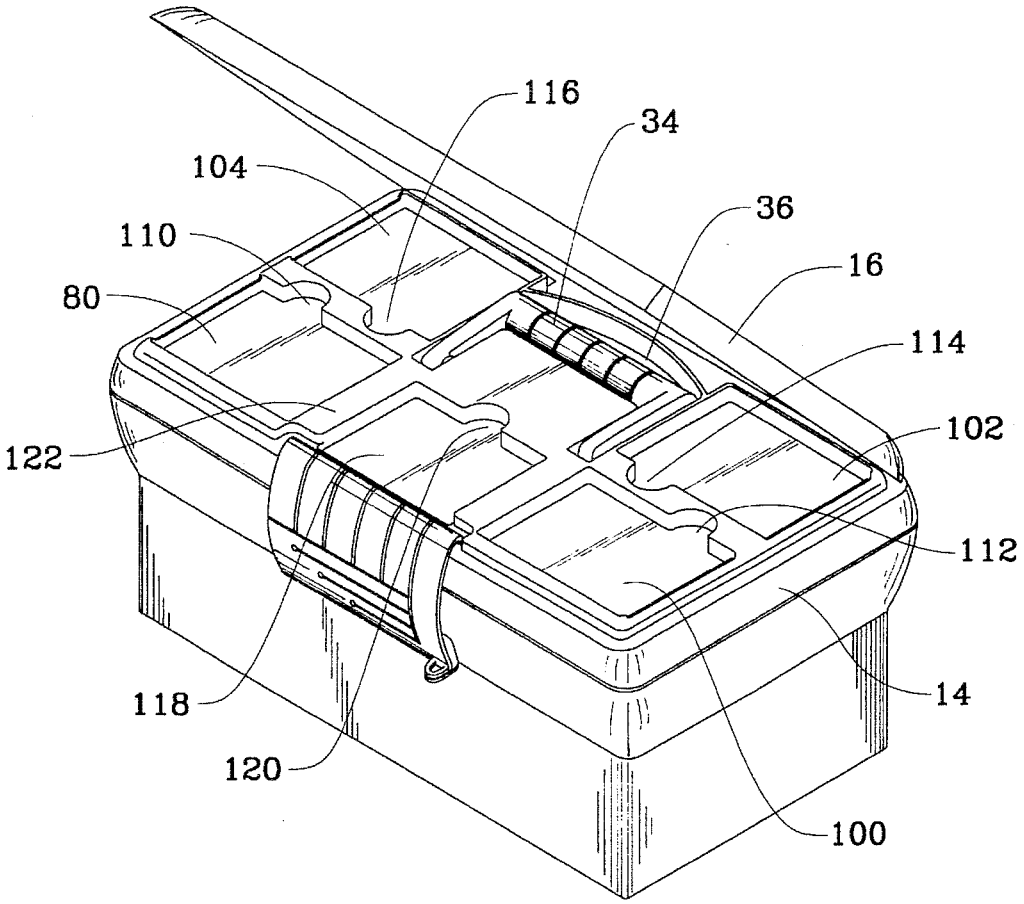
FIG. 4 is a perspective view with the lid in a closed position and the cover in a partially open position.

Now referring to FIG. 4 shown is the hidden compartment accessed by laying down handle 34 into lid receptacle 36 allowing cover 16 to be raised revealing trading card compartments 80. There are four identically sized trading card compartments 80, 100, 102, and 104. Each said compartment is sized to accommodate a box of trading cards which typically consists of 35 cards. Compartment 80 includes a finger hole 110 for ease of removal of trading cards or boxes with each compartment 100 having finger hole 112, compartment 102 having finger hole 114 and compartment 104 having finger hole 116 all providing ease of removal. A fifth compartment 118 is of reduced size for holding up to fifty cards in a loose format having finger hole 120 for ease of removal. It is noted that all aforementioned compartments have a depth of approximately 25 mm securely positioning the cards within raised side walls to protect the cards from damage. The inner surface of the cover 16, when placed in a closed position, abuts the upper surface 122 of the lid 14 maintaining cards in their respective compartments.

Figure 5:
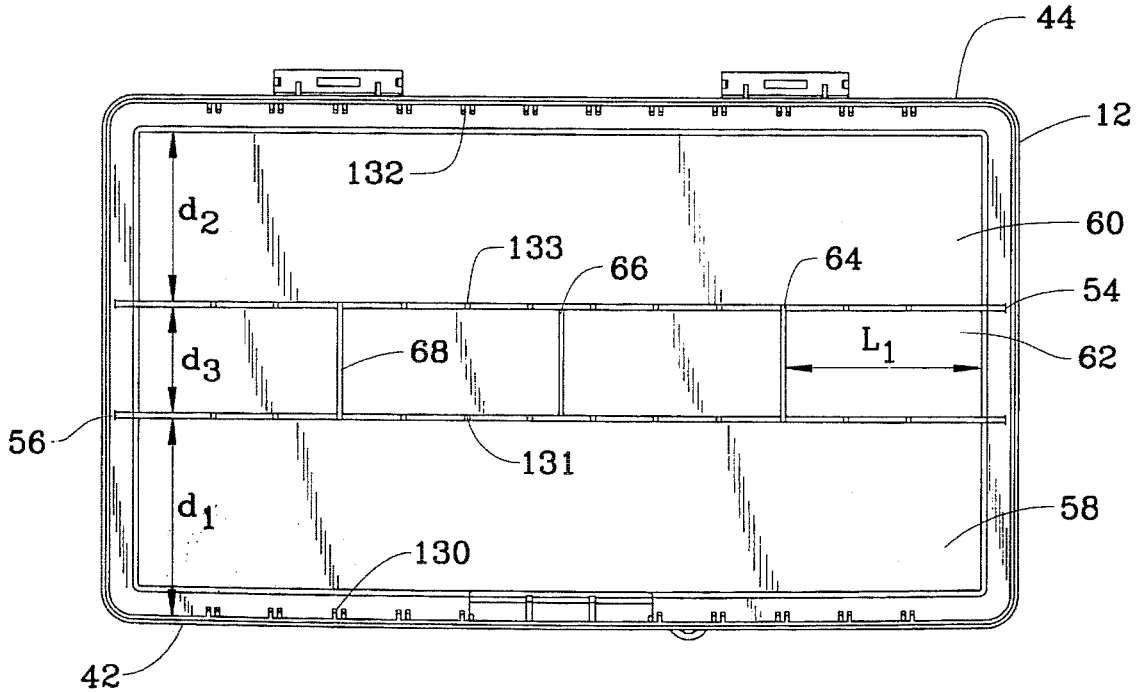
FIG. 5 is a top plane view of the storage cavity within the bin.

FIG. 5 sets forth a top plane view of the storage cavity illustrating front chamber 58 and rear chamber 60. Divider 56 is separated from the front wall 42 by a distance $d_1$ of approximately 80 mm. The spacing allows for placement of cards which can be divided by plastic inserts which fit within the depending tabs 130 placed along the longitudinal length of chamber 58. The plastic inserts have one end that mounts within tab 130 and a second end for insertion into holder 131. The plastic insertion cards allow an individual to separate the cards by year, team, and so forth. Rear chamber 60 assimilates the front chamber having divider 54 separated from rear wall 44 by a distance $d_2$ of approximately 80 mm. As with the front chamber 58, the longitudinal length of the rear chamber is lined with insert receptacles 132 and holders 133 which allow for the placement of plastic inserts perpendicular to the length of the chamber allowing the individual to separate the cards as previously mentioned. The center chamber 62 has cross-connect dividers 64, 66, and 68 maintaining a separation between divider 54 and 56 a distance $d_3$ of approximately 20 mm allowing for placement of card boxes or specialized cards placed within protective containers. Center chamber 62 is divided into four separate sections each having an equal length $l_1$ of approximately 80 mm.

Figure 6:
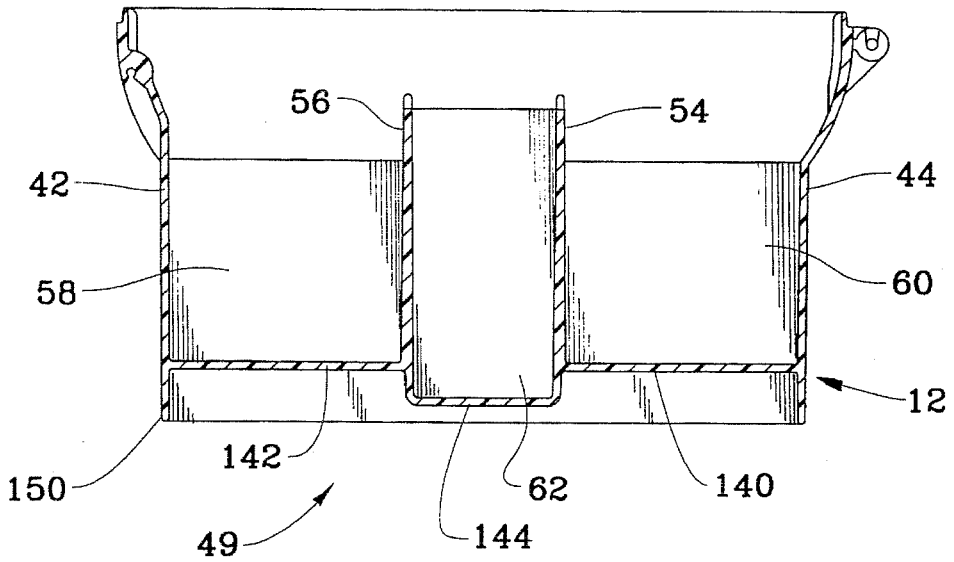
FIG. 6 is a cross-sectional side view of the bin.
Figure 7:
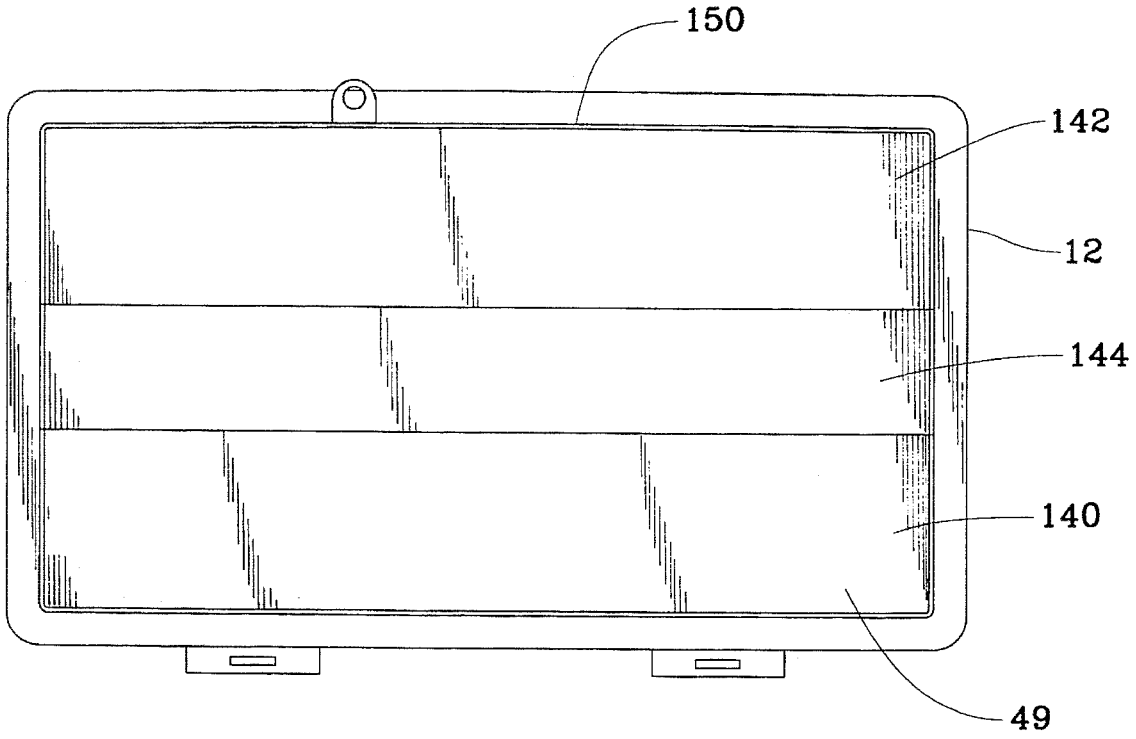
FIG. 7 is a bottom view of the bin.

FIG. 6 is a cross-sectional side view of the bin 12 illustrating rear chamber 60 having back wall 44, divider 54 and bottom wall 49 with section 140 disposed beneath rear chamber 60. Similarly, front chamber 58 is defined by center divider 56, front wall 42 and section 142 of bottom wall 49. Fixed dividers 54 and 56 separate center chamber 62 with section 144 providing the lower support platform of bottom wall 49. It is noted that sections 140 and 142 of bottom wall 49 are at a first height and section 144 of bottom wall 49 is at a second height, lower than section 142 and 140. As previously mentioned, the lowered section 144 provides additional space for placement of items within the center chamber such as those items placed in self-protective shields or boxes. Outwardly extending tab 150 is molded into the bottom wall 49 of bin 12 maintaining the bottom wall a raised distance above the floor surface to eliminate moisture transfer through condensation. It is noted that sections 140,142, and 144 are all raised above floor level which further allows the bin to be nested into the cover portion by placement around raised ridge 32, as illustrated in FIG. 1, with center section 144 of a height so as to be disposed above the molded indicia and allow positive securement of the outwardly extending tab 150 along an outer edge of raised ridge 32. Shown in FIG. 7 is a bottom view of the bin 12 depicting the longitudinal length of section 140 forming the surface for the rear chamber, section 142 forming the surface area for the front chamber and section 144 forming the surface area for the center chamber, all of which providing the support area for the bottom floor 49. Outward extending tab 150 is disposed around the outer surface of the sections.

Figure 8:
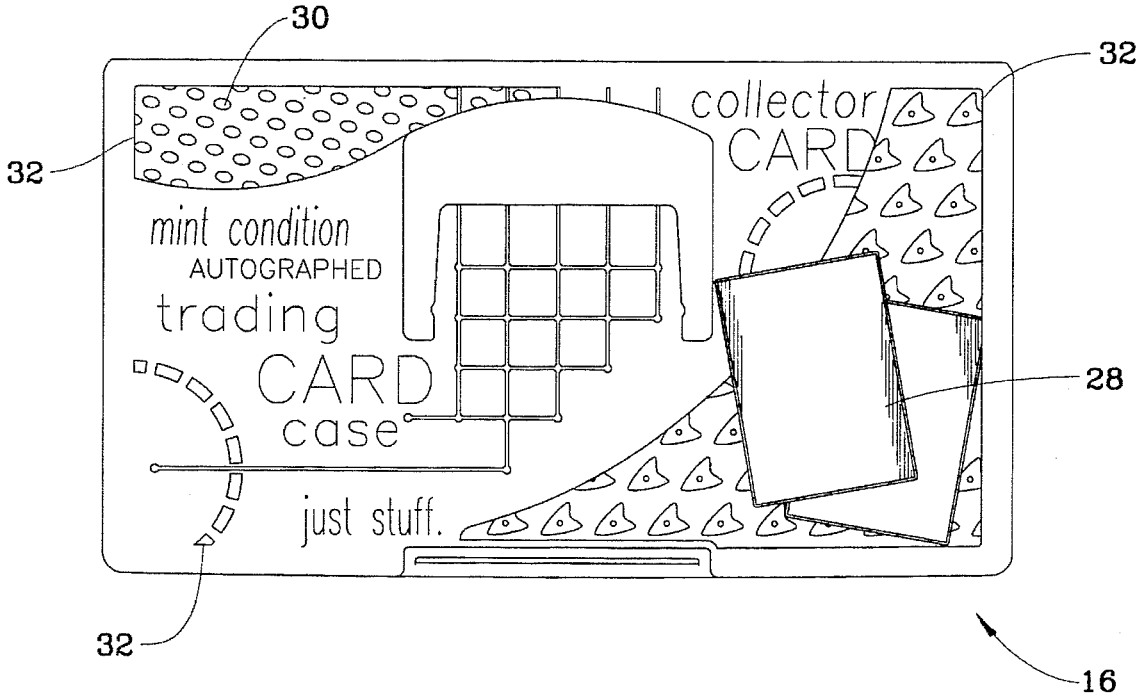
FIG. 8 is a top plane view of the trading card storage and display container.
Figure 9:
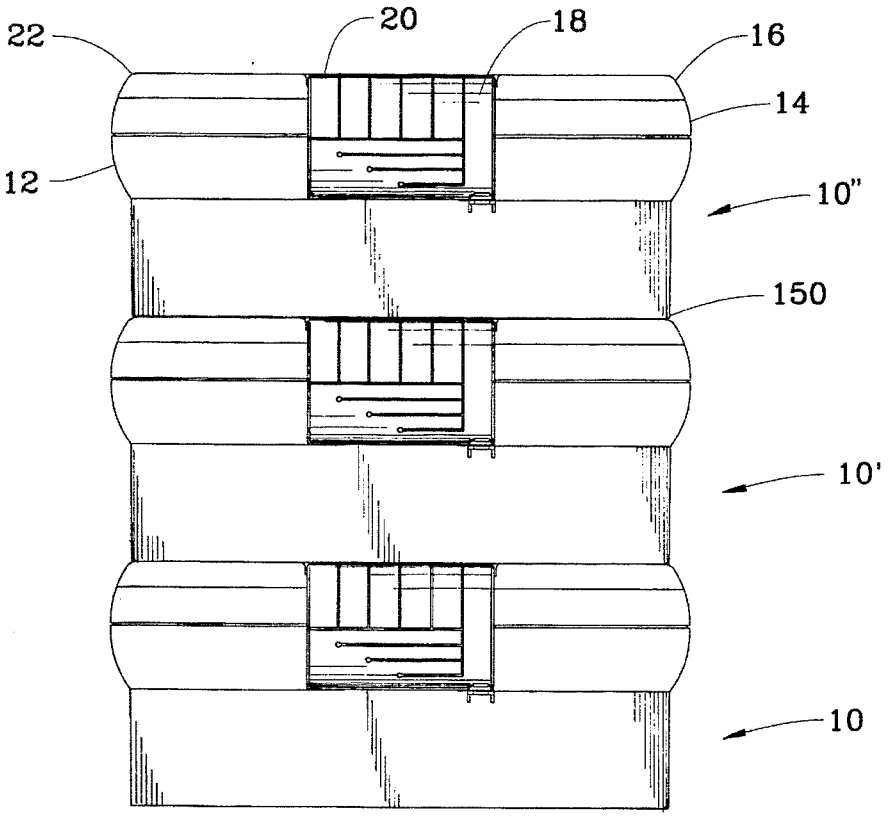
FIG. 9 is a side view of three containers placed in a stacked or nested position.

Referring to FIG. 8 shown is a top view of the cover 16 having the first area for indicia 28 which consists of a substantially flat rectangular section available for placement of stickers, numerals, labels and so forth so as to personalize the carrying case or indicate the contents therein. The remaining area of graphic-indicia molded therein including the Applicant's design work indicating the primary use of the carrying case for trading cards. It is noted that the perimeter edge 32 which provides a raised surface around the peripheral of the indicia allows for the outwardly extending tab, shown in FIG. 6 and illustrated in FIG. 9, to nest a plurality of containers on top of each other. The outward extending tab also fits over the cover of an adjoining container 10 providing for the secure nesting of individual containers. As noted by way of illustration the handle folds flush to the surface of the cover so as not to interfere with nesting, latch 18 having a locking lip to engage the cover 16 and lid 14 when placed in a closed position securely fastening the components to the bin 12 wherein the upper edge of the latch is in a horizontal plane with the upper surface 22 of the cover 16.

Figure 10:
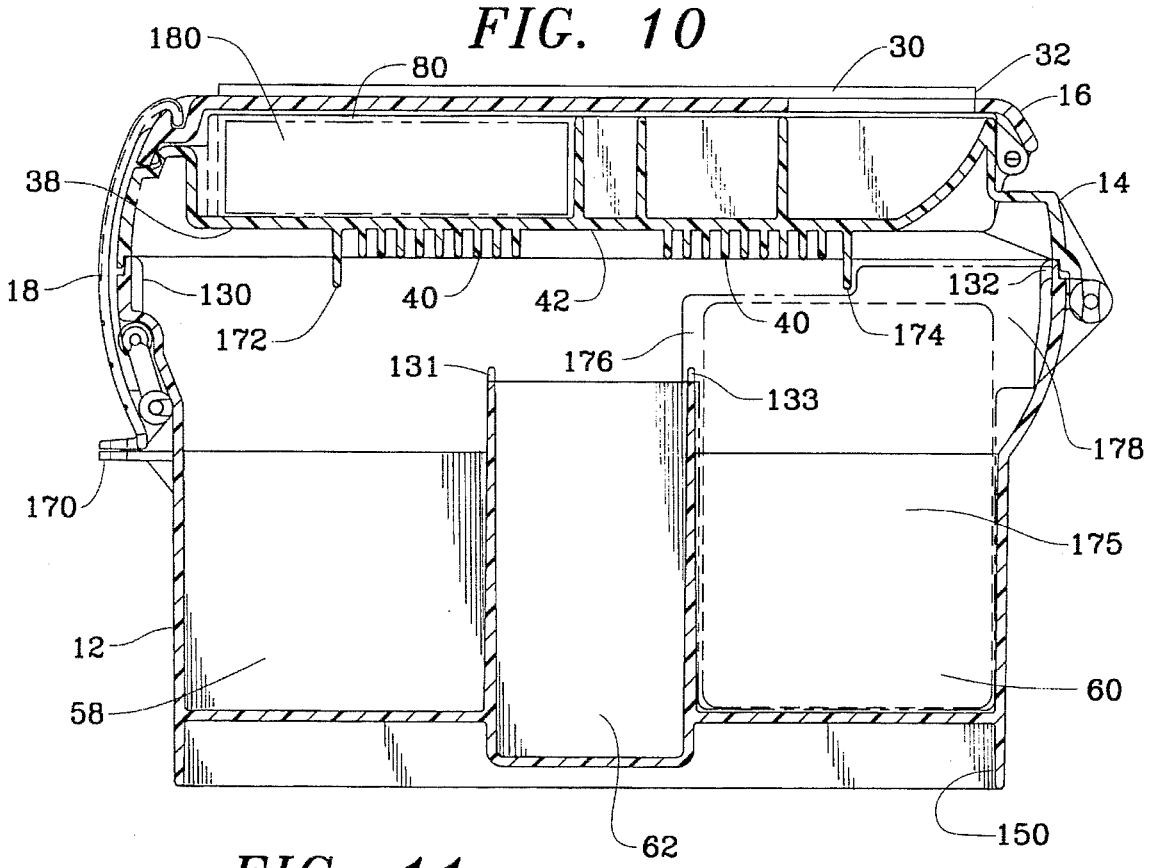
FIG. 10 is a cross-sectional view of the bin, lid, and cover.
Figure 11:
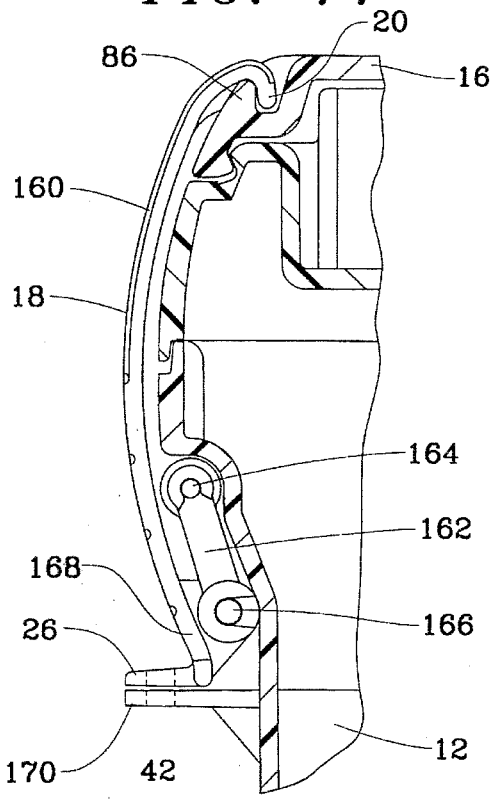
FIG. 11 is a cross-sectional view of the latch.
Figure 12:
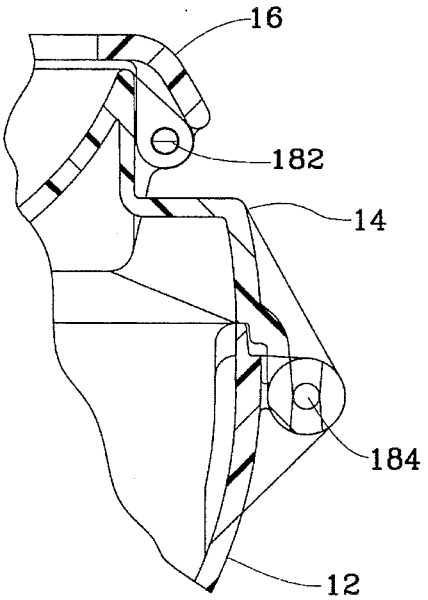
FIG. 12 is a cross-sectional view of the hinge for the lid and cover.

Now referring to FIGS. 10–12 the cross-sectional views illustrating the latch 18 which couples to the bin 12 with the lid 14 and the cover 16 in a closed position. The latch has a face plate 160 pivotally connected to the front wall 42 of bin 12 with a locking end 20 engagable with locking lip 86 in the top surface of the cover 16. The face plate 160 is pivotally connected to the front surface by a double jointed pivot 162 having a plurality of coaxial first pins 164 spaced in a fixed and substantially parallel relation from a second effective pivot pin 166, each of said first pivot pins being pivotally connected to the front surface of the bin 12. The latch 18 is released from an engaged position shown in FIGS. 10 and 11 by lifting up on hinged end 168 and lifting locking end 20 up and over locking lip 86. The latch is engaged by reversing this procedure. Lower tab 170 includes an aperture for latch tab 26 for insertion of a padlock so as to secure the latch 18 in a fixed position preventing the lifting of the cover 16 or lid 14.

When the lid is placed in a closed position, as illustrated in FIG. 10, the plurality of ridges 40 located on the lower surface 38 of the lid 14 are inverted. The raised ridges 172 and 174 are centrally disposed over the front 58 and rear chamber 60 respectively and sized to prevent excessive movement of cards placed while placed therein. Trading card 175 is depicted in chamber 60 having an upper edge bounded by ridge 174 with each side edge bounded by the walls of the chamber. This tolerance prevents movement of the cards to prevent damage thereto.

Void depicted by numeral 43 runs along the longitudinal length between tabs 40 wherein placement of oversized cards within the center chamber 62 will have sufficient room to allow for proper closure without damage to the cards. Plastic loose leaf dividers 176 are provided for placement within the front or rear chambers 58, 60 wherein the dividers 176 allow an individual to organize cards by league, team, player, year, and so forth. The loose dividers 176 fit within each receptacles 132 and detente 133 on the rear chamber 60 and receptacles 130 and detentes 131 on the front chamber 58. The dividers provide a substantially vertical position to prevent the cards from tipping over when placed between appropriately spaced dividers. By way of illustration, the card box 180 is placed within compartment 80 of lid 14 wherein the card box is hidden from view when the cover is opened revealing only the contents within the storage cavity. Indicia 30 is denoted on the top surface of cover 16 with the peripheral edge 32 surrounding the indicia which is operatively associated with an inner surface of outward extending tab 150 placed along the bottom surface of the bin 12. The cover 16 is rotatably attached to the lid 14 by hinge 182 and the lid 14 is rotatably attached to the bin 12 by hinge 184. Hinge 182 is discretely concealed beneath an angular lip of cover 16 with hinge 184 in a pronounced position so as to provide the illusion that the top of the container consists of a single top hinged to the bin by hinge member 184. Hinge 182 being discretely disclosed would not provide the viewer with indication that the cover 16 is of a separate component.

It is to be understood that while we have illustrated and described certain forms of our invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A plastic trading card storage and display container comprising: a bin defined by a front wall, two side walls, a rear wall and a bottom wall forming a storage cavity with an upper first peripheral edge forming an opening to said storage cavity; a lid hingedly attached to said bin and having an upper surface with a second peripheral edge and a lower surface with a third peripheral edge operatively associated with said first peripheral edge forming complementary mating edges; handle means rotatably coupled to said upper surface of said lid; a cover hingedly attached to said lid and having a top surface with a centrally disposed U-shaped aperture allowing said handle means to rotate into a recessed storage position being flush with said top surface and an upright carrying position extending through said aperture, and a bottom surface with a fourth peripheral edge operatively associated with said second peripheral edge forming a complementary mating edges; and latch means for holding said cover to said bin securing said lid therebetween.

2. The trading card container according to claim 1 wherein said aperture includes at least one locking lug, said handle means including a locking notch to engage said lug when said handle is in a carrying position, wherein said lug and said notch secure said handle means in a perpendicular position to said lid and maintaining said cover in a fixed position to said lid.

3. The trading card container according to claim 1 wherein said handle means is further defined as a handle grip extending between first and second handle arms, said arms having a length sized to support said lid in a horizontal plane when said lid is placed in an open position.

4. The trading card container according to claim 1 wherein said upper surface of said lid includes a plurality of compartments sized to accept trading cards in a horizontal plane, and a U-shaped recessed holder for placement of said handle means in a storage position.

5. The trading card container according to claim 1 wherein said top surface includes a first area for placement of personalized graphic indicia and a second area having graphic indicia molded therein, said first and second area forming a ridge available for nesting another container having a complementary surface.

6. The trading card container according to claim 1 including an outwardly extending tab molded into said bottom wall of said bin, said tab maintaining said bottom wall a raised distance from a floor surface and forming a mating ridge for nesting another container having a complementary surface.

7. The trading card container according to claim 1 wherein said latch means includes a face plate having a hinged end pivotally connected to said front wall of said bin and a locking end engagable with a locking lip in said top surface of said cover.

8. The trading card container according to claim 1 wherein said latch means is defined by a face plate being pivotally connected to the front surface of said bin by a double-jointed pivot, said pivot having a plurality of coaxial first pivot pins spaced in a fixed and substantially parallel relation from a second effective pivot pin, each of said first pivot pins being pivotally connected to the front surface of one of said bin by a first pivot plate and said second effective pivot pin being pivotally connected to the hinged end of said face plate.

9. The trading card container according to claim 1 wherein said lower surface of said lid includes a plurality of spaced apart raised tabs wherein said tabs are receptive to holding a plurality of trading cards for display thereof.

10. The trading card container according to claim 1 wherein said storage cavity includes two fixed dividers parallelly spaced apart and positioned a fixed distance from said front wall and said rear wall along a longitudinal length of said cavity forming a front and rear longitudinal chamber whereby a plurality of trading cards may be placed in said front and rear chambers upright and perpendicular to said longitudinal length.

11. The trading card container according to claim 10 wherein said front and rear chambers include a means for separating cards placed along the longitudinal length of each chamber.

12. The trading card container according to claim 10 wherein a plurality of cross connects are positioned between said dividers forming a center chamber with four chamber sections whereby a plurality of trading cards may be placed in said chamber sections upright and parallel to said longitudinal length.

13. The trading card container according to claim 12 wherein the bottom wall of said front and rear chambers is at a first height and the bottom wall of said center chamber is of a second height, said first height greater than said second height.

14. A plastic trading card storage and display container comprising:

a bin defined by a front wall, two side walls, a rear wall, and a bottom wall forming a storage cavity with an upper first peripheral edge forming an opening to said storage cavity, a pair of spaced apart fixed dividers coupled to each said side wall positioned a fixed distance from said front wall and said rear wall forming a front longitudinal chamber and a rear longitudinal chamber and three cross connects positioned between said dividers forming center chambers, said bottom wall of said front and rear chambers having a first height and said bottom wall of said center chamber having a second height less than the first height;

a lid hingedly attached to said bin and having an upper surface with a second peripheral edge and a lower surface with a third peripheral edge operatively associated with said first peripheral edge forming complementary mating edge, said upper surface having a plurality of recessed compartments sized to accept trading cards in a horizontal plane; handle means having a handle grip extending between first and second handle arms, one end of said arms rotatably coupled to said upper surface of said lid with a locking notch disposed on a side surface of said arms;

a cover hingedly attached to said lid and having a top surface with a centrally disposed U-shaped aperture having a locking lug to engage said locking notch when said handle is in a carrying position locking said cover to said lid, and a bottom surface with a fourth peripheral edge operatively associated with said second peripheral edge forming a complementary mating edges; and latch means for holding said cover to said bin securing said lid therebetween, said latch means having a face plate pivotally connected to the front wall of said bin and a locking end engagable with a locking lip in the top surface of said cover.

15. The trading card container according to claim 14 wherein said top surface includes a first area for placement of personalized graphic indicia and a second area having graphic indicia molded therein, said first and second area forming a ridge available for nesting another container having a complementary surface on a bottom wall of a bin.

16. The trading card container according to claim 14 including an outwardly extending tab molded into said bottom wall of said bin, said tab maintaining said bottom wall a raised distance from a floor surface to and forming a mating ridge for nesting another container having a complementary surface.

17. The trading card container according to claim 14 wherein said lower surface of said lid includes a plurality of spaced apart raised tabs wherein said tabs are receptive to holding a plurality of trading cards for display thereof.

18. The trading card container according to claim 14 wherein said lower surface of said lid includes a plurality of spaced apart raised tabs wherein said tabs are receptive to holding a plurality of trading cards for display thereof.

19. The trading card container according to claim 14 wherein said arms have a length sized to support said lid in a horizontal plane when said lid opened.

20. The trading card container according to claim 14 wherein said face plate of said latch means is pivotally connected to the front surface of said bin by a double-jointed pivot, said pivot having a plurality of coaxial first pivot pins spaced in a fixed and substantially parallel relation from a second effective pivot pin, each of said first pivot pins being pivotally connected to the front surface of one of said bin by a first pivot plate and said second effective pivot pin being pivotally connected to the hinged end of said face plate.

* * * * *